United States Patent [19]

Arbeus

[11] Patent Number: 4,981,417

[45] Date of Patent: Jan. 1, 1991

[54] CLOSED TYPE IMPELLER

[75] Inventor: Ulf Arbeus, Lidingo, Sweden

[73] Assignee: Flygt AB, Solna, Sweden

[21] Appl. No.: 391,343

[22] Filed: Aug. 8, 1989

[30] Foreign Application Priority Data

Sep. 14, 1988 [SE] Sweden ..... 8803233

[51] Int. Cl.[5] ..... F04F 5/48

[52] U.S. Cl. ..... 416/186 R; 416/179

[58] Field of Search ..... 416/179, 183, 185, 186 R; 415/228, 227, 206

[56] References Cited

U.S. PATENT DOCUMENTS 867,069 9/1907 Neumann ..... 416/186 R 2,101,653 12/1937 Schellens ..... 416/179

FOREIGN PATENT DOCUMENTS 51992 4/1980 Japan ..... 416/186 R 146275 11/1980 Japan ..... 416/186 R

*Primary Examiner*—John T. Kwon

*Attorney, Agent, or Firm*—Menotti J. Lombardi

[57] ABSTRACT

An impeller for pumps, turbines, fans, etc., of the closed type, having a number of vanes arranged between cover discs. In order to reduce the secondary flows within the impeller, the secants between the suction side of the vane and the cover discs are displaced with respect to the intersections at the pressure side of the vane. This impeller is rotationally non-symmetrical.

3 Claims, 1 Drawing Sheet

CLOSED TYPE IMPELLER

BACKGROUND OF THE INVENTION

The invention concerns an impeller of a so-called closed type for pumps, compressors, fans, etc. of a centrifugal or semiaxial type.

Impellers of this type are characterized by being arranged to rotate within a housing into which a liquid or a gas is fed through a central axial opening. The medium flows through one or several channels, where the energy is increased, and is finally expelled at the periphery of the impeller. The velocity of the medium is normally decelerated, thus giving the medium an additional static pressure increase.

An impeller of a so-called closed type comprises a cover disc (shroud) having a central hole for medium coming into the impeller, another cover disc (hub) heading the driving unit and a number of vanes arranged between the cover discs, which vanes are curved and which between themselves form channels for transport of the medium towards the periphery. There may be different numbers of vanes and designs depending on the type of medium that is transported, the volume rate, the head, etc.

When pumping liquids containing solid bodies, such as waste water, etc., it is desirable to have as large a free passage as possible through the impeller. It is therefore common to design the impeller to have one single vane as this allows the largest possible free passage. An example of such an impeller is shown in the Swedish Patent No. 7903729-7. One disadvantage with this type of impeller, in addition to manufacturing problems, is that it is not symmetrical and therefore difficult to balance. Another disadvantage is that the efficiency is not as high as possible. It is therefore common to use impellers with several vanes, in spite of their more narrow passages An example of such an impeller is shown in the Swedish Patent No. 306 706.

In German Patent Application No. 35 30 985 there is shown how it is possible to decrease the flow losses in an impeller by designing the cover discs rotationally non-symmetrical. A reduction of the distance between the cover discs on the suction side is proposed, however, this will not have any significant influence on the secondary flow, since the divergence in the meridian plane is mainly the same on the suction and the pressure sides of the impeller. This arrangement thus does not provide any significant reduction of the loss that is due to secondary flow.

SUMMARY OF THE INVENTION

An object of this invention is to further improve the qualities of impellers of the above mentioned type.

Another object of the invention is to provide an impeller which decreases fluid losses and thus increase the efficiency of the machine.

An additional object of the invention is to provide a pump wherein the cavitation qualities are improved.

A feature of the invention is that the impeller is suitable for waste water pumps since it provides the free passage required.

According to the broader aspects of the invention, a number of vanes are arranged between the hub and shroud discs, the secants between the suction side of the vanes and the discs are displaced with respect to the intersections at the pressure side of the vane.

BRIEF DESCRIPTION OF THE DRAWINGS

Other objects, features, and advantages of the invention will become more fully apparent from the following detailed description of the preferred embodiment, the appended claims and the accompanying drawings, in which:

DETAILED DESCRIPTION OF THE PREFERRED EMBODIMENT

Figure 1:
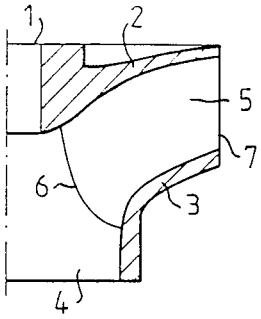
FIG.1 (PRIOR ART)
FIG. 1 is a meridian section of a pump impeller according to the prior art.

Referring to FIG. 1, there is shown a hole 1 for mounting a driving shaft, and cross sections of cover discs comprising hub 2 and shroud 3. The impeller has a pump inlet 4 and a vane 5 having a leading edge 6 and a trailing edge 7.

Figure 2:
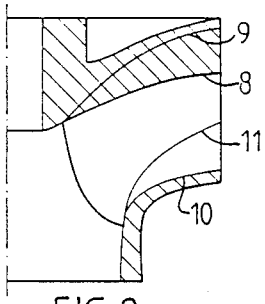
FIG. 2 is a meridian section of the pump impeller according to the invention.

In FIG. 2, there is shown the intersections 8,9 between the hub 2 and the vane 5 at its pressure and suction side respectively, and the intersections 10, 11 between the shroud 3 and the vane 5 at its pressure and suction side respectively.

Figure 3:
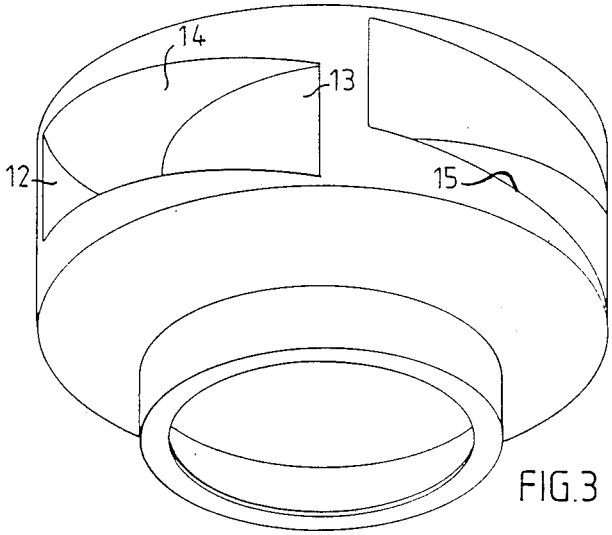
FIG. 3 shows a perspective view of a pump impeller according to the invention.

In the FIG. 3 perspective view, there is illustrated the suction side 12 and the pressure side 13 respectively of the vane 5, and the inner sides 14, 15 of the cover discs.

FIG. 1 thus shows a section of a conventional prior art, closed impeller with several vanes. The hub 2, adjacent the driving unit, and the opposite cover disc, the shroud 3, and there between a number of vanes 5. The liquid is sucked into the impeller through the central opening 4 in the shroud 3 and leaves the impeller through the openings of the channels of vane 5 at the periphery.

The flow in a pump impeller of this type is not uniform. Described in a simplified way, the flow can be said to be altered in two main directions. One from the axial inlet towards the radial outlet and the other in the form of a substantially increased tangential velocity from inlet towards outlet.

Each alteration of a flowing medium brings about a secondary current emanating from the boundary layers adjacent the channel wall. The secondary flows are loaded with the same pressure gradients as the free flow in the center of the channel. This entails a transport of medium from areas having a high pressure towards areas of lower pressure. As a consequence the boundary layers tend to increase in low pressure zones where the losses will be concentrated.

Areas of high and low pressures respectively in the channel mainly originate from the fact that the vane 5 has a high pressure side 13 turned forward in the direction of rotation and a low pressure side 12 turned away from the direction of rotation. In addition, the change in direction of the fluid from the axial inflow to the radial outflow from the impeller requires that the high pressure side also occurs at the hub 2 and that a low pressure side occurs at the shroud 3.

According to the invention, the inner sides of the cover discs, the areasthat limit the channels on two sides, are so designed that the secondary flow mentioned above is reduced. This is obtained by forming the inner sides rotationally non-symmetrical, meaning that seen in a meridian plane through the impeller, the secants between the surfaces of the cover discs and the suction side of the vane deviate from corresponding projections in the meridian plane of the secants between surfaces of the cover disc and the pressure side of the vane, said deviation being zero at the leading edge and increases towards the trailing edge. The deviation is obtained by the radius of curvature at the cover discs being bigger at the suction side of the vane as compared with its pressure side.

The advantage with this design is, as mentioned before, that the secondary flow within the impeller is considerably diminished which means a better efficiency and improved cavitation qualities.

FIG. 3, which is a perspective view of an impeller according to the invention, shows the cross sections of the channels at their outlets at the impeller periphery. The suction and pressure sides 12, 13 respectively of the vanes, and the inner sides 14, 15 of the cover discs.

By forming the channels as described above, the zones, where the secondary flow tends to concentrate blocking boundary layers will diminish as the pressure differences deriving from the deviation in the meridian section are adapted to the suction and pressure sides respectively of the vane. This provides an important improvement of the efficiency and the cavitation qualities. Therefore the vane angles may be increased giving larger throughput.

While the present invention has been disclosed in connection with a preferred embodiment thereof, it should be understood that there may be other embodiments which fall within the spirit and scope of the invention as defined in the following claims.

What is claimed is:

1. A closed type impeller for pumps, compressors, fans, etc., of a centrifugal or semiaxial type, including two cover discs and a number of curved vanes arranged between said cover discs, which vanes between themselves form channels and which vanes each have a pressure side turned forward in the direction of rotation and a suction side turned backwards, characterized in that the projections in the meridian plane of the intersections between the cover discs and the suction side of the vane deviates from the corresponding projections in the meridian plane of the intersections between the cover discs and pressure side of the vane, the deviation being zero at the leading edge of the vane at an impeller inlet and increases towards the trailing edge of the vane at an impeller outlet; and that the distances between the cover discs of the channel height are mainly the same at the suction and the pressure sides respectively.

2. A closed impeller according to claim 1, characterized in that the projection in the meridian plane of the suction side of the vane has a bigger radius of curvature as compared with that of the pressure side at both cover discs.

3. In a closed type impeller having two cover discs and a number of curved vanes arranged between said cover discs, said vanes forming channels there between, and each of said vanes having a pressure side turned forward in the direction of rotation of the impeller and a suction side turned backward of the direction of rotation of the impeller, wherein the improvement comprises that a meridian plane projection of the intersection between the cover discs and the suction side of each said vanes deviates from corresponding projections in a meridian plane projection of the intersection between said cover discs and the pressure side of each said vanes, and that the deviation is zero at the leading edge of each said vanes at the impeller inlet and increases towards the trailing edge of each said vanes at the impeller outlet; that the meridian plan projection on the suction side of each said vanes has a bigger radius of curvature at said cover discs compared to that on the pressure side of each said vanes; and that the channel height between said cover discs is substantially the same at the suction and pressure side of each said vanes.

* * * * *